US006446688B1

(12) United States Patent
Sutton

(10) Patent No.: US 6,446,688 B1
(45) Date of Patent: Sep. 10, 2002

(54) CARRY BAG WITH POUCH INSERT AND COVER

(76) Inventor: Alice B. Sutton, P. O. Box 687, Davidson, NC (US) 28036

( * ) Notice: Subject to any disclaimer, the term of this patent is extended or adjusted under 35 U.S.C. 154(b) by 0 days.

(21) Appl. No.: 09/666,069

(22) Filed: Dec. 6, 2000

Related U.S. Application Data

(62) Division of application No. 09/237,755, filed on Jan. 26, 1999, now Pat. No. 6,179,025.

(51) Int. Cl.[7] ..... B65D 33/10; A45C 3/08

(52) U.S. Cl. ..... 150/105; 150/110; 150/113; 383/13

(58) Field of Search ..... 150/103, 104, 150/105, 110, 113; 383/13

(56) References Cited

U.S. PATENT DOCUMENTS

| | | | | | |
|---|---|---|---|---|---|
| D164,621 | S | * | 9/1951 | Bienen | 150/103 |
| 2,799,316 | A | * | 7/1957 | Cohen | 150/103 |
| 3,414,033 | A | * | 12/1968 | Tucker | 150/104 |
| 3,923,222 | A | * | 12/1975 | Groves | 224/58 |
| 4,754,790 | A | * | 7/1988 | Meyers | 150/104 |
| 4,995,436 | A | * | 2/1991 | Cantor | 150/102 |
| 5,197,525 | A | * | 3/1993 | Cantor | 150/102 |
| 5,207,254 | A | * | 5/1993 | Fromm | 150/104 |
| 5,490,619 | A | * | 2/1996 | Boyar | 224/153 |
| 5,503,204 | A | * | 4/1996 | Byers et al. | 150/105 |
| 5,829,502 | A | * | 11/1998 | Distefano et al. | 150/113 |
| 5,894,975 | A | * | 4/1999 | Holden et al. | 224/582 |
| 5,911,262 | A | * | 6/1999 | Steinhart | 150/103 |
| 5,983,969 | A | * | 11/1999 | Morgan | 150/104 |
| 6,003,573 | A | * | 12/1999 | Owens | 150/104 |
| 6,095,213 | A | * | 8/2000 | Roegner | 150/106 |
| 6,186,201 | B1 | * | 2/2001 | Salz | 150/105 |
| 6,230,952 | B1 | * | 5/2001 | Jupiter | 224/655 |

* cited by examiner

*Primary Examiner*—Stephen P. Garbe
(74) *Attorney, Agent, or Firm*—Harlston Law Firm; Kathleen M. Harleston

(57) ABSTRACT

A carry bag with a pouch insert and magnetic fasteners is provided. The carry bag comprises a three-dimensional, generally rectangular pouch having a zipper or drawstring closure in the top face and a detachable carrying strap. One portion of each magnetic fastener is secured to each end face of the front and back faces of the pouch, and an opposite portion of each magnetic fastener is secured to the carrying strap.

6 Claims, 10 Drawing Sheets

CARRY BAG WITH POUCH INSERT AND COVER

CROSS REFERENCE TO RELATED APPLICATIONS

This is a division of U.S. patent application Ser. No. 09/237,755, filed Jan. 26, 1999, now U.S. Patent No. 6,179,025.

C. STATEMENT REGARDING FEDERALLY SPONSORED

RESEARCH OR DEVELOPMENT

Not Applicable

D. REFERENCE TO A MICROFICHE APPENDIX

Not Applicable

E. BACKGROUND OF THE INVENTION

1. Technical Field

The present invention relates to a carry bag with a pouch insert, magnetic fasteners, and interchangeable covers, particularly handbags, diaper bags, briefcases, knapsacks, and tote bags.

2. Background Information

With the diversification of the roles of women over the past few decades, fashion has changed to meet the needs of the career woman who is also a mother and homemaker. In times past, women would change their purses to match their outfits and the occasion. Women today for the most part are not inclined to sacrifice the extra time it takes to transfer the contents of their purses several times a day in order to coordinate their purse to their outfit or the occasion. Also, handbags today can be expensive, and having a handbag for each outfit or occasion is prohibitively expensive for the majority of women. It is nevertheless often still necessary to switch purses, as when converting from casual clothes or office gear to evening wear.

One handbag-related problem recognized many years ago is the soiling of handbag exteriors. Purse inserts with buttonholes to match buttons in exterior coverings were created so that the exterior covering could be removed, laundered, and replaced. It was later found that this allowed the user to switch between similar but different colored exterior coverings. Problems related to changing purses to go with one's outfit or shoes include the time it takes to switch the purse contents, and inadvertently leaving behind items in the old purse. Quite a few things tend to accumulate in purses, particularly the purses of mothers of babies or toddlers, and purse changing can be an undesirable, time-consuming ordeal. Various solutions have not entirely solved these problems. Continuing problems include loss of items from open-mouth purses or purse inserts, increasing complexity of purses with interior pockets and flaps, inefficient means for fastening a cover to a foundation bag, and undesirable bulkiness or heaviness of the resulting handbag. The present invention solves these and other problems.

F. BRIEF SUMMARY OF THE INVENTION

The present invention is a carry bag with a pouch insert and magnetic fasteners. The pouch is preferably inserted into one of many different types of bag covers. The carry bag of the present invention comprises: a) a three dimensional, generally rectangular-shaped, closable pouch that comprises six exterior faces: front and back, two ends, bottom, and top;

b) a closure means in the top face of the pouch, preferably a zipper or drawstring closure; c) at least two magnetic fasteners; and d) a detachable carrying strap. One portion of each magnetic fastener is secured to each end face, or the front and back faces, of the pouch, and an opposite portion of each magnetic fastener is secured to the carrying strap. The portions of the magnetic fasteners on the carrying strap correspond to the magnetic portions on the pouch, so that a user can quickly and easily attach the carrying strap to the pouch, and then detach it from the pouch. Alternatively, the carry bag comprises the pouch and one or more interchangeable covers. The cover comprises an open, three dimensional, generally rectangular-shaped, cover compartment with four sides and a bottom. The cover compartment is of sufficient size to snugly accommodate the pouch. Each compartment comprises a magnetic fastener portion that corresponds to an opposite magnetic fastener portion on the pouch, so that the pouch without the detachable carrying strap can be quickly and easily inserted into, or detached from, the cover.

G. BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein:

FIG. 1 shows a perspective view of a handbag with a pouch and cover according to the present invention;

FIG. 2*a* shows an exploded perspective view of a first embodiment of a pouch handbag with a detachable carrying strap according to the present invention;

FIG. 2*b* shows a perspective view of a circular strap according to the present invention;

FIG. 2*c* shows an exploded perspective view of a second embodiment of a pouch handbag with a detachable carrying strap according to the present invention;

FIG. 3 shows a perspective view of a briefcase with a pouch and cover according to the present invention;

FIG. 3*a* is a perspective view of a carry bag according to the present invention, showing a exterior pocket;

FIG. 3*b* is a perspective view of a carry bag according to the present invention, showing two exterior pockets;

FIG. 3*c* is a perspective view of a carry bag according to the present invention, showing two carrying straps;

FIG. 3*d* is a perspective view of a carry bag, kit according to the present invention;

H. DETAILED DESCRIPTION OF THE INVENTION

Figure 1:
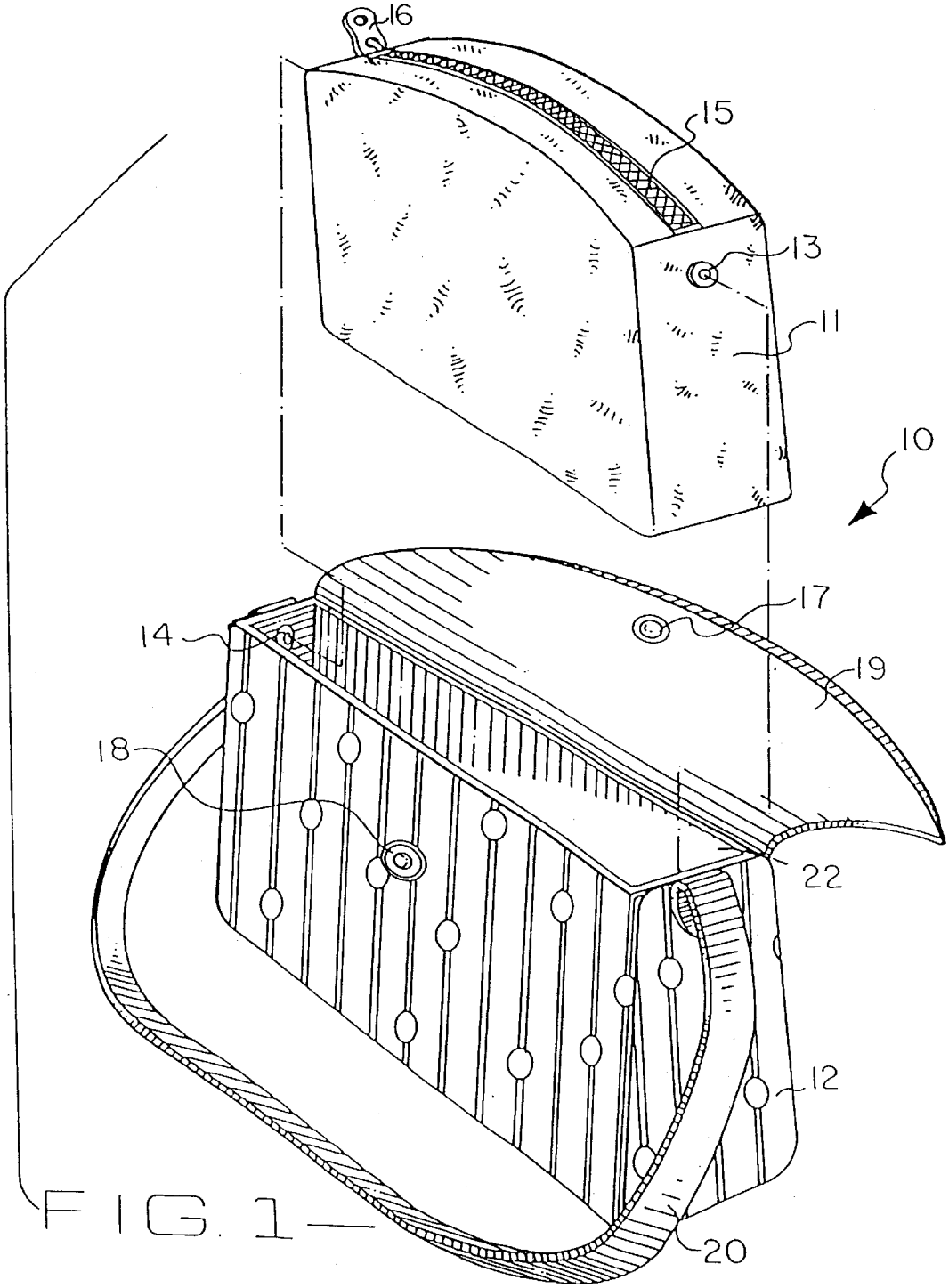

In the following description, like reference characters designate like or corresponding parts throughout the several views. Also, in the following description, it is to be understood that such terms as "front," "back," "top," "bottom," "end," and the like are words of convenience and are not to be construed as limiting terms. Referring in more detail to the drawings, the invention will now be described.

Referring to FIG. 1, a carry bag 10 according to the present invention comprises an inner pouch 11 and an exterior cover 12. Carry bags herein can be carried by a person and used to store personal items. The pouch 11 is a three dimensional, generally rectangular-shaped, closable pouch having six faces: front and back, two ends, bottom, and top. The front and back faces are two substantially parallel, opposite, principal walls, and the two ends of the pouch are substantially parallel and opposite to each other. Each of the two end faces of the pouch 11 in FIG. 1 comprises a male (or female) magnetic snap fastener portion 13. The magnetic snap portion 13 is preferably secured to the exterior of the pouch in the approximate center of the upper extremity of the end face. The pouch 11 is substantially comprised of a flexible, sturdy material. The pouch 11 is preferably substantially free-standing and made of a material which does not collapse when, for example, the pouch is set upright on a surface or propped against a chair leg or other post.

Regarding FIG. 1, the cover 12 of the present invention comprises an open, three dimensional, generally rectangular-shaped cover compartment 22. The cover compartment is of sufficient size to snugly accommodate the pouch 11. The cover compartment includes a front, a back, a bottom, and two compartment ends which are opposite and generally parallel to each other. Each compartment end comprises a magnetic snap fastener portion 14 that corresponds to an opposite magnetic snap fastener portion 13 on the pouch 11, so that the pouch 11 without a detachable carrying strap can be quickly and easily inserted into, or detached from, the cover 12. The magnetic snap fastener portions 14 are secured to the upper extremities of the interior faces of the ends of the cover 12, roughly in the center.

The corresponding portions of the magnetic snap fasteners 13, 14 attract each other because of an internal magnet; they do not require force in order to secure the male portion to the female portion of the magnetic snap fastener. Because it is easy to secure the magnetic fasteners, the pouch can be quickly attached to, and even more easily removed from, the cover. "Changing purses" is thus quick and easy when the present invention is employed.

Preferably two magnetic snap fasteners are sufficient and therefore preferred for use herein. Various suitable types of magnetic snap fasteners are commercially available. A suitable magnetic snap fastener for use herein includes a female portion with first and second plates, and a male portion with third and fourth plates. A magnetic member is attached to one of the plates of the female portion. Rivets may be used to hold the plates of each portion together. Each plate may include a central portion which protrudes into an opening defined by the magnetic portion. The snap may have a cylindrical or other form. Another suitable magnetic fastener includes a permanent magnet with ferromagnetic plates attached to either side. For use, the permanent magnet and one plate may be attached to a body, with the other plate member being attached to a cover, so that it serves as a fastener in an opening and closing portion of a handbag or the like. A third suitable type of magnetic snap fastener includes a tubular or partially sealed hollow stem with a central opening. The stem fits into a hole in a magnet to connect each of two portions of the fastener.

In the embodiment of FIG. 1, the pouch 11 fits securely into the cover 12. The pouch 11 comprises a zipper closure 15 with a zipper pull 16 on its top face. The top face of the pouch 11 can be slightly curved to make the zipper 15 more accessible to the user and easier to pull, and to add structure to the pouch. The zipper 15 allows the user to access a central storage area in the pouch 11. The top face may curve with a greater arc than is shown, and the ends of the zipper may extend down into the end faces of the inner pouch. In that case, the magnetic fasteners could be placed lower, or off-center and to the left or right of the zipper ends. The pouch 11 and/or the cover 12 may include interior and/or exterior pockets for organization of items in the bag. The pouch preferably comprises one or two interior zippered pockets, but preferably no exterior pockets. The cover may also comprise a means for opening and closing the carry bag.

Referring to FIG. 1, an optional exterior flap 19 can be sewn along the top edge of the back face of the cover 12. In FIG. 1, the exterior flap 19 comprises a female (or male) exterior magnetic snap 17 which corresponds to a male (or female) magnetic snap 18 on the front face of the cover 12. The male magnetic snap 18 is preferably secured in the approximate center of the front face of the cover so that the female magnetic snap 17 contacts it when the exterior flap 19 is lowered over the front of the cover. In FIG. 1, opposite ends of a carry strap 20 are attached to the ends of the cover 12.

The inner pouch can very quickly and easily be inserted in the cover by simply dropping it into the corresponding space or compartment in the cover. Part of the versatility of the present invention lies in the fact that the inner pouch is designed to fit in a wide variety of covers. In general, the covers vary more widely than do the pouches. A wide variety of coverings, such as beach bags, tote bags, luggage, knapsacks, lunch boxes, fanny packs (waist packs), bags which circle or strap onto the wrist (wrist bags), bags for attachment to a belt (belt bags), camera bags, bags for carrying telephones (phone bag), briefcases, cosmetic bags, organizers, and many different types of handbags and shoulder bags, can be designed to fit the same or different inner pouches. The user can, for example, insert the inner pouch into a handbag or briefcase cover in the morning, then remove the pouch from the handbag or briefcase cover in the afternoon and drop it into a diaper bag cover to pick up her baby from day care. Later, she can remove the pouch from the diaper bag cover and insert it into an evening bag cover for a night out.

A user's individual needs and tastes will be met by covers for larger or smaller pouches, which all fall within the scope of this invention. Pouches can be made in several different shapes. Examples of various pouch embodiments are illustrated in FIGS. 1, 3, 4, 6, 7 and 8. Each type of pouch could fit interchangeably into the various covers illustrated, as well as into other embodiments. For deep (wide) covers such as tote bags, the magnetic fasteners may be positioned lower in the carry bag so that the pouch rests on the bottom or floor of the carry bag. In long carry bags such as briefcases, one of the magnetic fastener portions on the cover may be placed on a divider wall. The divider wall may extend across the whole width of the interior of the cover, or it may leave more room inside the carry bag by extending for only part of the carry bag's width. In most handbag embodiments, the cover compartment will occupy the majority of the space in the interior of the handbag cover. In larger carry bags such as knapsacks or diaper bags, the cover compartment for the pouch may be attached inside or outside the front or back wall of the cover.

Figure 2A:
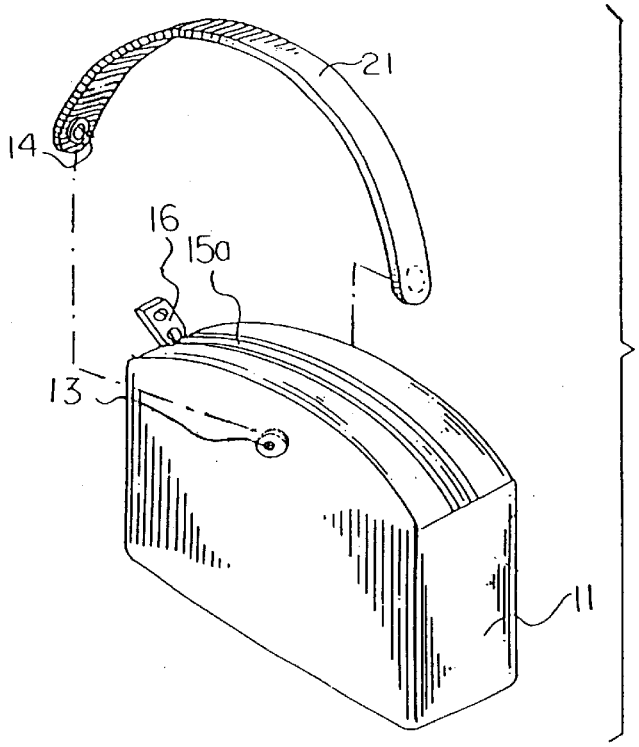
Figure 2B:
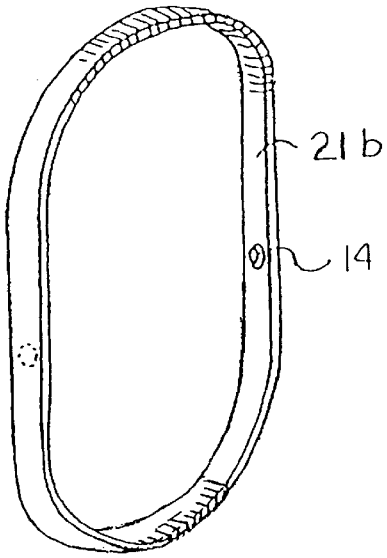
Figures 2C, 3:
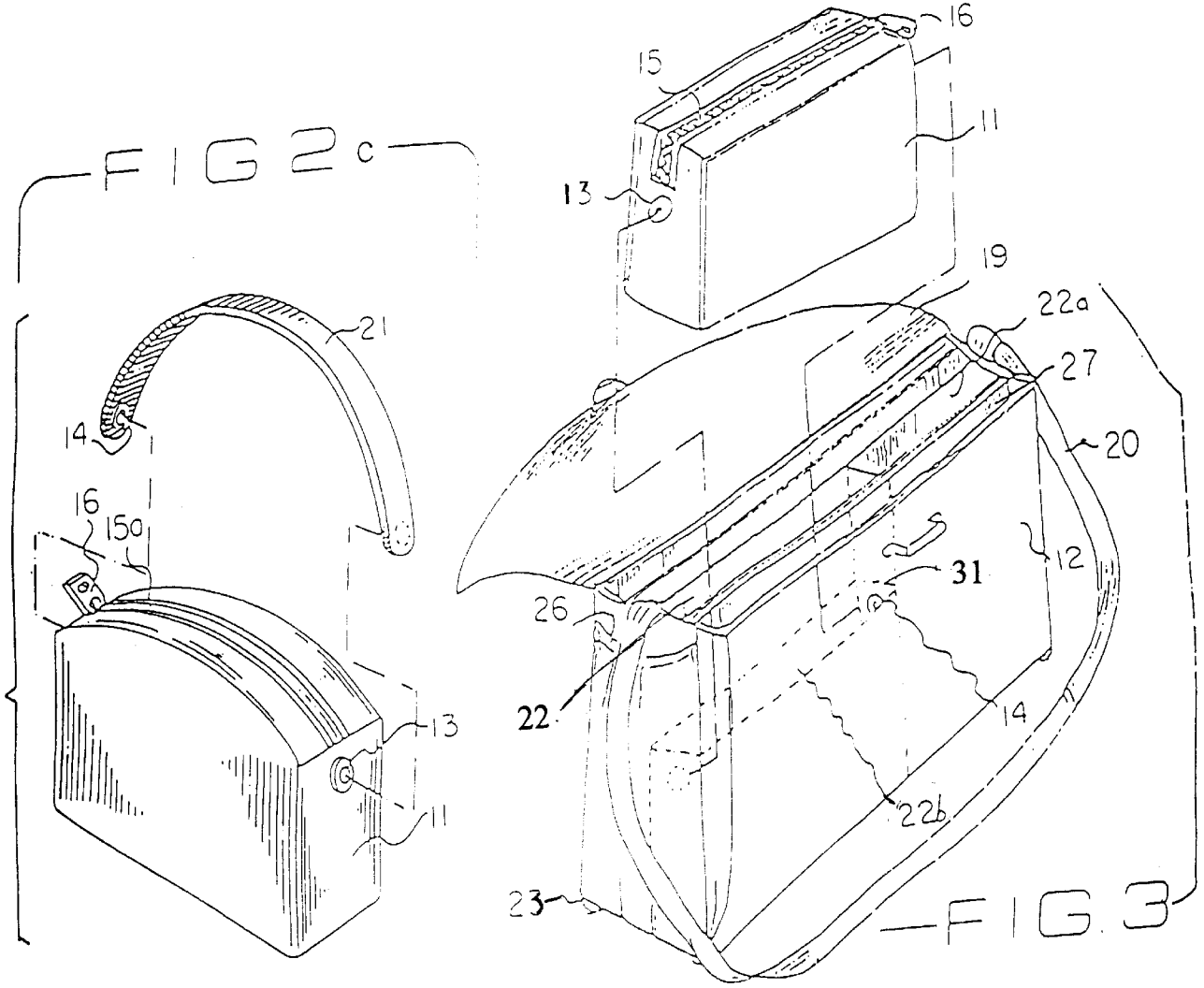

Referring to FIGS. 2*a* and 2*c*, the carry bag 10 of the present invention may comprise only a pouch 11 and a detachable (removable) carrying strap 21. The detachable carrying strap, either: 1) has two opposite ends (preferred) with a corresponding portion of each magnetic fastener secured to each end of the carrying strap; or 2) is a circular strap 21*b*, as shown in FIG. 2*b* with corresponding portions of each magnetic fastener secured on the inside of the strap opposite to each other, a bottom section of the circular strap being available to support the pouch, and an opposite, top section of the circular strap being free for carrying on a user's shoulder or hand. As shown in FIGS. 2*b* and 2*c*, the detachable carrying strap 21 has magnetic snap fastener portions 14 secured to its opposite ends. These correspond to the magnetic snap fastener portions 13 at the ends of the pouch 11. FIG. 2*a* shows an alternate embodiment of the pouch with carrying strap, with the corresponding magnetic fastener portions 13 on the front face, and indicated on the back face of the pouch. The carrying strap 21 is preferably for smaller, lightweight inner pouches intended to carry fewer items. The pouch 11 of the present invention is preferably of a flexible material of sufficient texture, color, and decoration to function as a purse by itself. The pouch 11 is not a rigid shell, but it is preferably made of a sturdy material so that it maintains its structure even when it is filled with sundry personal articles. The detachable carry strap 21 can be quickly removed if, for example, the user wishes to change to a more structured handbag by inserting the pouch 11 into a handbag cover 12. Another advantage of the detachable carry strap 21 is that the strap can be rotated down and out of the way of the zipper or drawstring opening in the top of the pouch when the handbag is not being carried even without detaching the carry strap.

The pouch 11 may be small enough to hold just a few items, such as a lipstick, keys, and eyeglasses, or large enough to tote many items. Pouch sizes may range, for example, from about 4 inches long, 3 inches wide, and 1 inch thick, which would be adaptable to fit a wrist or belt pocketbook, to about 15 inches long, 13 inches wide, and 6 inches thick. A pouch of sufficient size to fit a standard-sized handbag cover is about 9½×7½×2½ inches.

The top face of the inner pouch 11 holds a hidden zipper closure 15*a* with a zipper pull 16. The zipper closure of the inner pouch may be metal, nylon, plastic, or any other suitable material, and may be straight, curved, flat, hidden or "invisible." The zipper preferably extends across the middle (lengthwise) of the top face of the inner pouch.

In reference to FIG. 3, a pouch 11 fits into a like-sized, open cover compartment 22 in a briefcase or satchel-like cover 12 with an exterior flap 19. The cover compartment 22 is shown in FIG. 3 by broken lines. The cover 12 also has a storage compartment 22*a*. which is adjacent to the cover compartment for the pouch, for holding other objects. The cover compartment 22 comprises an interior partition 31, which divides the cover compartment 22 into the pouch compartment 22*b* and another compartment 22*a*, and two pouch compartment ends, which are opposite and generally parallel to each other, the interior partition 31 comprising one of tee pouch compartment ends. One of the magnetic snap fastener portions 14 is secured on an inside end of the briefcase cover, and the other magnetic snap fastener portion 14 is secured to an attached tab, or to a divider wall as illustrated with broken lines in FIG. 3. It does not matter whether the magnetic fastener portions 14 inside the compartment arc male or female, so long as their corresponding magnetic fastener portions 13 on the pouch are the opposite (i.e., their mates). The divider wall separates the interior of the cover into compartments. Other than the divider wall, the other sides of the cover compartment are formed by the walls and bottom of the cover. A compartment sewn on or otherwise attached to the inside front wall of the cover and also having the magnetic fastener portions can be use as an alternative method of securing the pouch inside the cover. A study carrying strap 20 is attached to the ends of the briefcase cover 12. Other types of carrying straps may be employed. One end of the cover has an outer storage pocket 26 for holding, for example, a cell phone, planner, palm-top computer, or calculator. Taps 23 can be secured to the four corners of the bottom of the cover 12 to reduce scuffing.

The cover compartment 22 comprises an interior partition 31, which divides the cover compartment 22 into the pouch compartment 22 and another compartment 22*a*, an two pouch compartment ends, which are opposite and generally parallel to each other, the interior partition 31 comprising one of the pouch compartment ends.

Figure 3A:
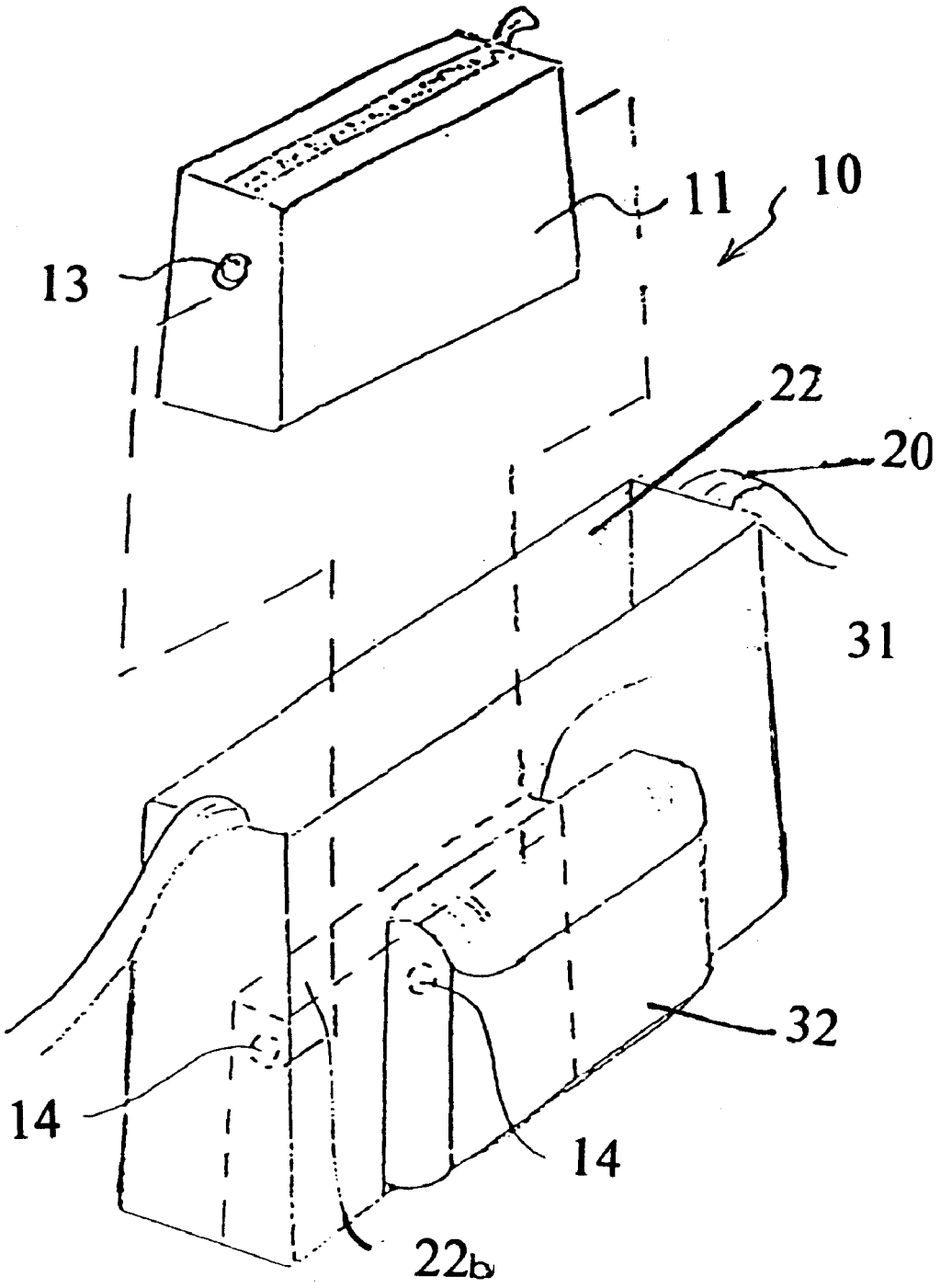
Figure 3B:
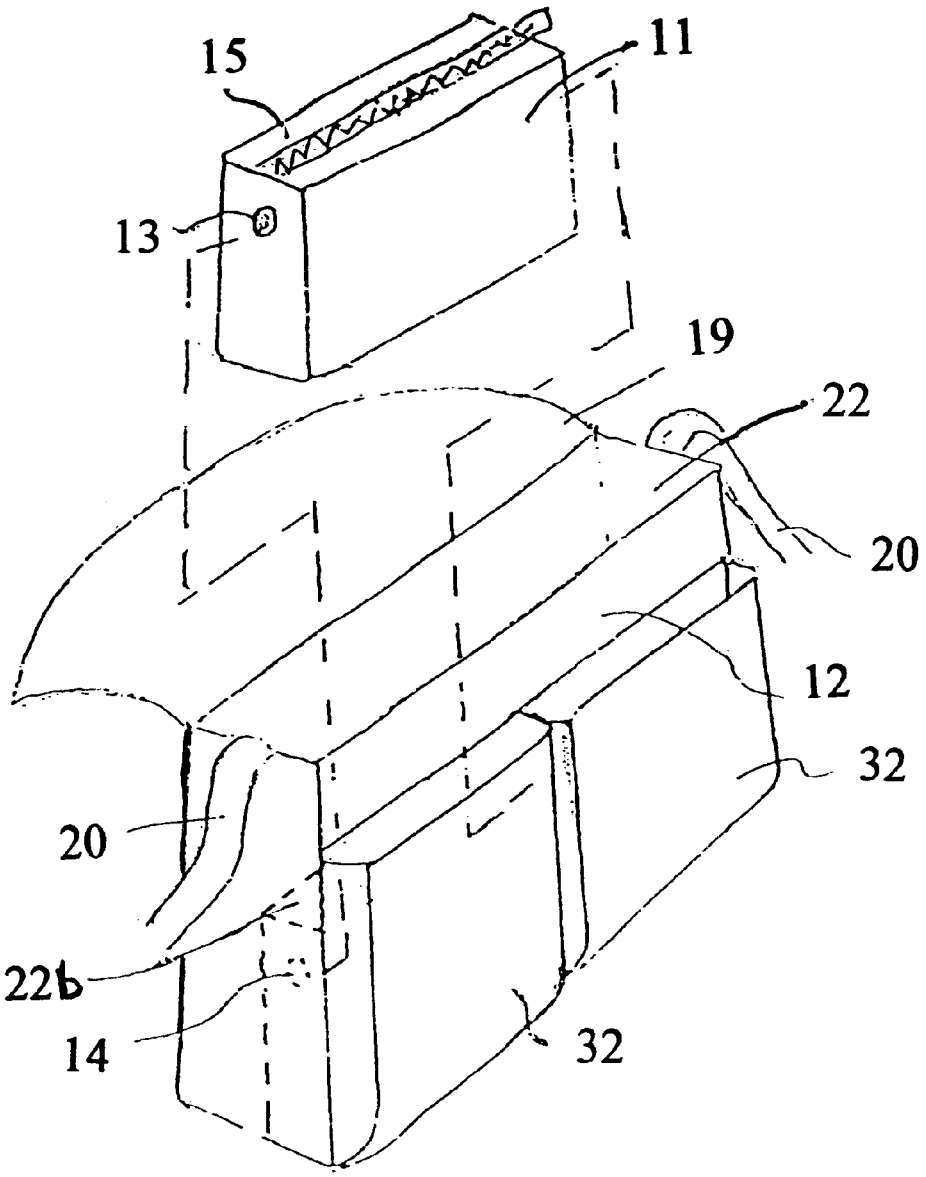
Figure 3C:
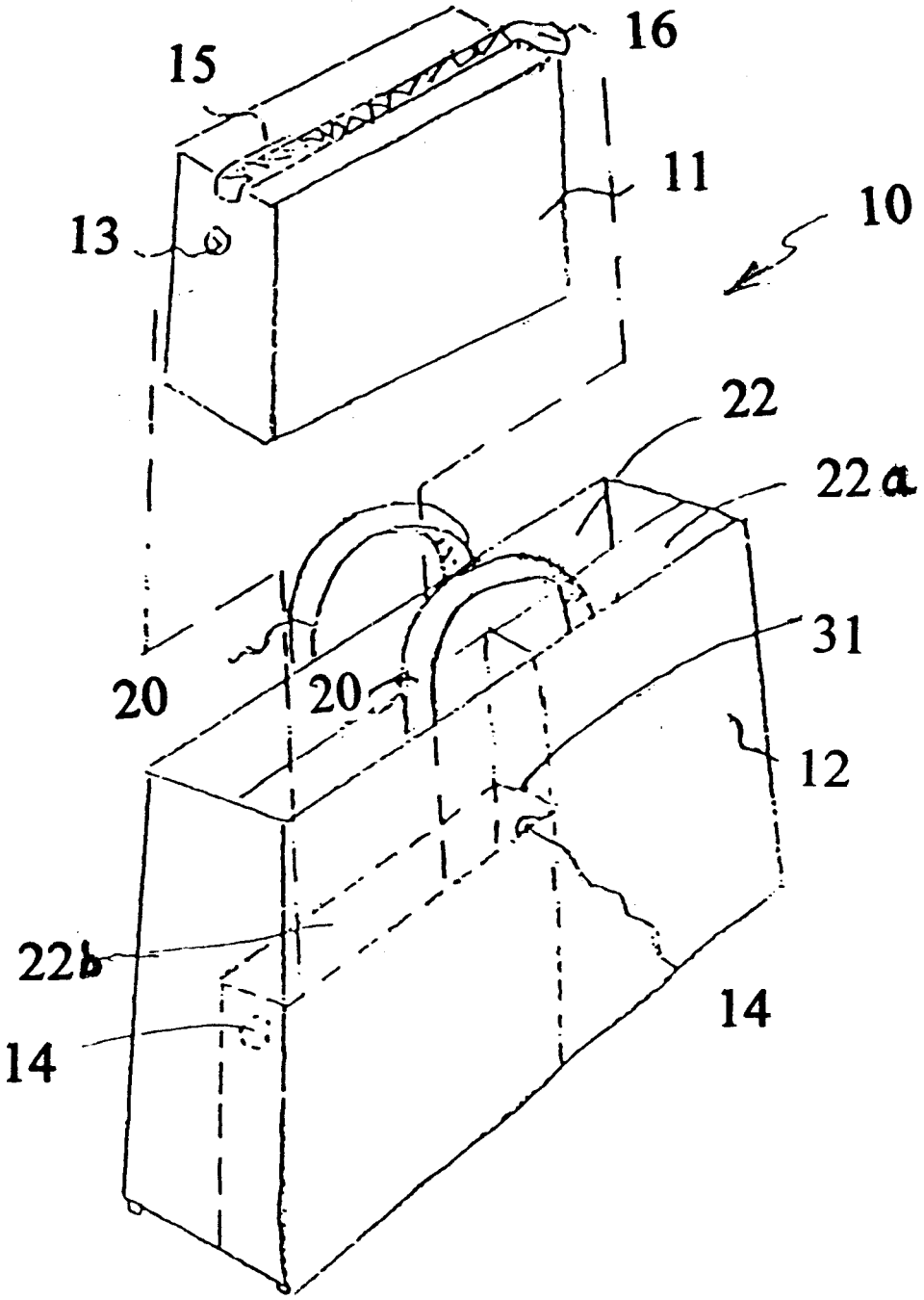

FIG. 3*a* shows a carry 10 with an inner pouch 11, which is insertable into a pouch compartment 22*b*. Interior partition 31 forms an end of pouch compartment 22*b*. The front of the carry bag 10 holds an exterior pocket 32, which can also function as a pouch compartment to receive a pouch 11. In FIG. 3*b*, a carry bag 10 has two adjacent exterior pockets 32. FIG. 3*c* illustrates a carry bag 10 having an interior partition 31 and two carrying straps 20.

Covers 12 for use herein may be made of leather, straw, nylon, or any suitable plastic or fabric. They may be made of fabric layered over a backing for stiffness. The pouch 11 preferably fits snugly into the cover 12. The cover 12 can have its own exterior closure such as an exterior flap 19. With closures on both the pouch 11 and the cover 12, the contents of the bag are less likely to spill out when the bag is tipped over. Although the pouch 11 is secured to the cover 12 with magnetic fasteners or the like, hook and loop fasteners (also called flexible tape strips) may be employed elsewhere in or on the bag. Hook and loop fasteners, though, are not preferred for fixing the inner pouch to the cover because hook and loop has a tendency to catch hair and other particles that commonly accumulate in purses. Over time, the hook and loop fastener strips often become so dirty that corresponding strips will not fasten to each other. Magnetic fasteners do not have this problem.

The opposite ends of the pouch and the cover preferably are made of a material which is relatively straight and does not buckle so that the magnetic fastener portions easily contact each other. This facilitates quick insertion of the pouch 11 in the cover 12.

Also included in the present invention is a kit with which a user can put together two or more different carry bags for different outfits or occasions. The kit comprises a pouch 11, a detachable carrying strap 21, and one or more covers 12 of different colors and/or materials. The carry bag 10 can be, for example, a handbag, shoulder bag, briefcase, tote bag, diaper bag, evening bag, beach bag, piece of luggage, knapsack, lunch box, waist (fanny) pack, wrist bag, bag for attachment to a belt, camera bag, phone bag, or organizer (e.g. for cosmetics or jewelry).

Figure 3D:
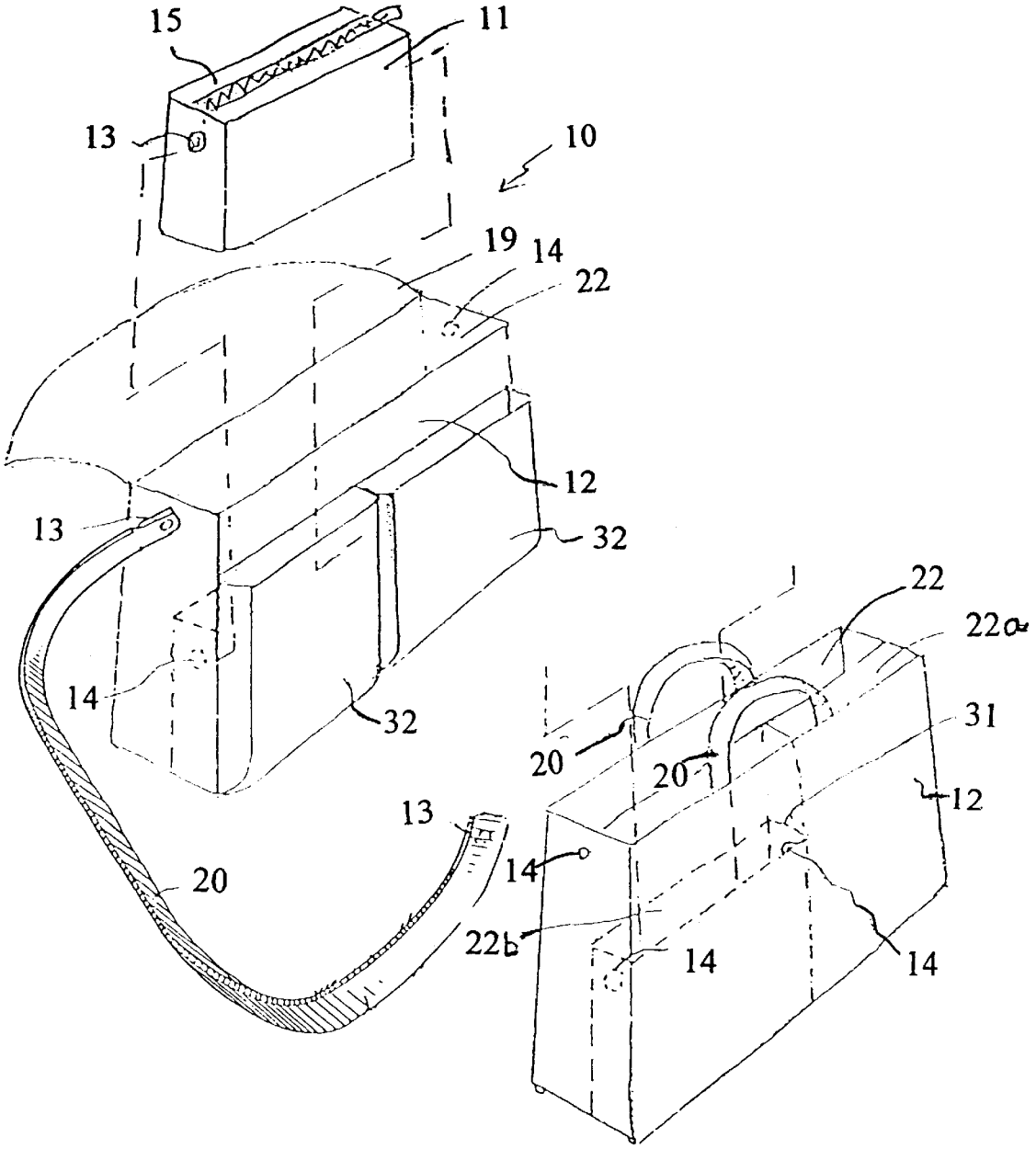

In FIG. 3*d*, a kit includes a pouch 11, which is insertable in a pouch compartment 22*b* in either of two covers 12. The pouch 11 includes a zipper closure 15 in its top face. A piece of luggage is shown at left, and an organizer is shown at lower right in FIG. 3*d*. The kit also includes a detachable carrying strap 20 with a magnetic fastener portion 13. attached to each end. These correspond to magnetic fastener portions 14 on the outside ends of the carry bags 10.

Figure 4:
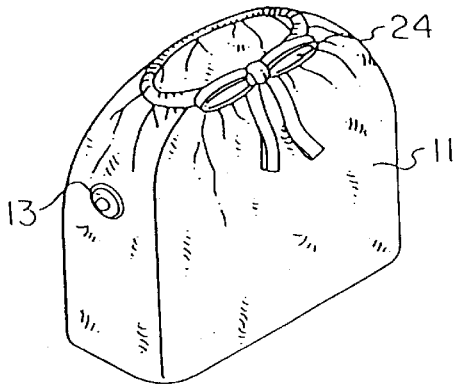
FIG. 4 shows a perspective view of a pouch with a drawstring closure according to the present invention.

Regarding FIG. 4, the pouch 11 of the present invention may have a drawstring closure 24 or the like rather than a zipper closure 15. Although the drawstring closure 24 can be more difficult for a user to open than a zippered pouch, the drawstring is attractive, particularly where the cover is open at the top. A user can open a drawstring closure by undoing the bow or knot and then widening the tight circle formed by the drawstring closure by coaxing it apart with her hands. This pulls the drawstring through the circular tunnel sewn in the pouch fabric, which widens the opening. The opening can be closed again by pulling the two ends of the drawstring relatively tight and then tying them together. The pouch with drawstring closure 24 can be used by itself with a detachable carrying strap 21 as shown in FIG. 2. It is also attractive when it is inserted in an open straw summer bag cover. The interior ends of the open straw bag or other cover would have magnetic fastener portions 14 that correspond to the magnetic fastener portions 13 on the exterior ends of the inner pouch 13.

Another preferred embodiment of the present invention is a handbag with a substantially free-standing pouch. The pouch has a zipper or drawstring closure; and the handbag comprises two magnetic snap fasteners, each having a male portion and a corresponding female portion. One magnetic fastener portion is secured to each end face of the pouch, and the opposite two magnetic fastener portions are attached to the circular detachable carry strap.

Figure 5:
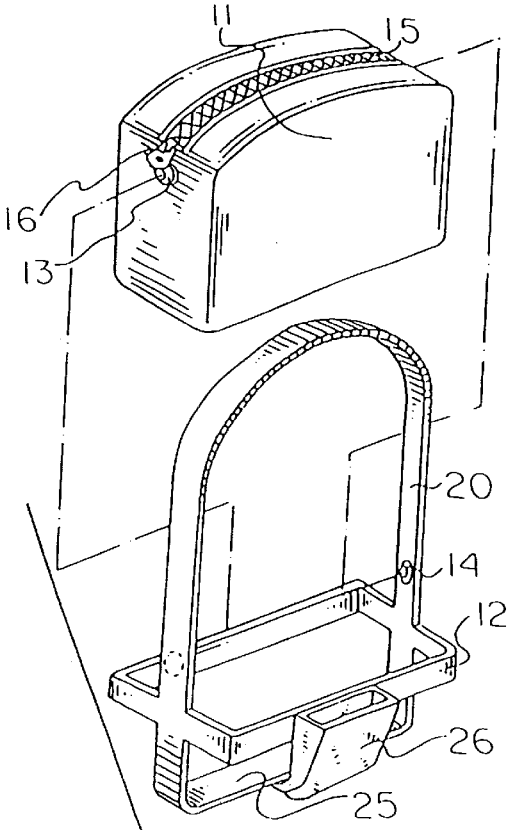
FIG. 5 shows a perspective view of a handbag with a pouch insert and a tiered cover according to the present invention.
Figure 6:
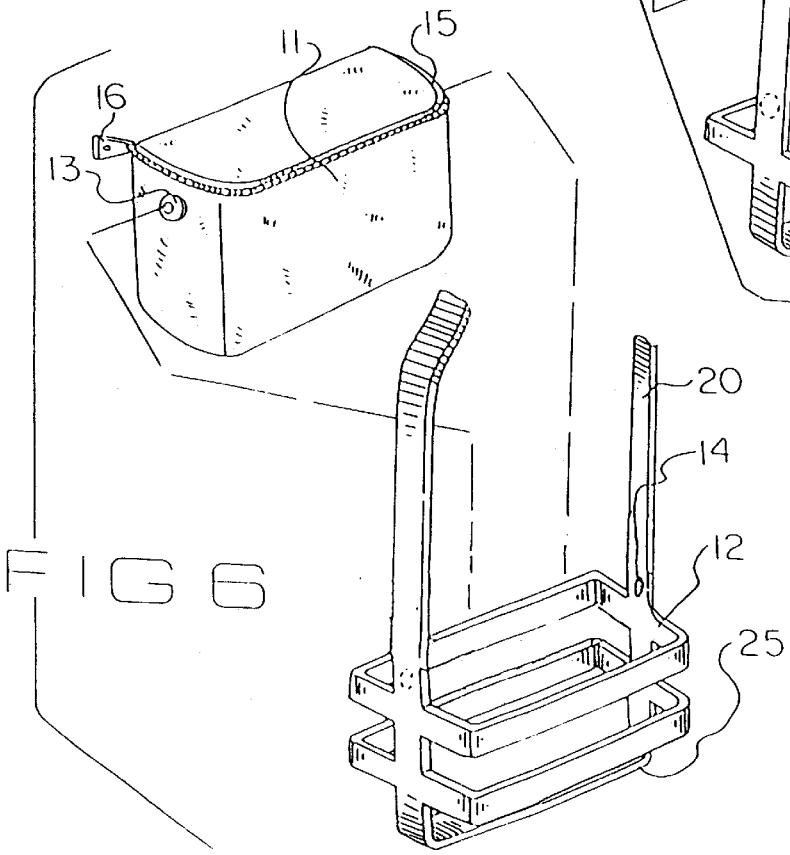
FIG. 6 shows a perspective view of a handbag with a pouch insert and a multi-tiered cover according to the present invention.

FIG. 5 shows another carry bag embodiment. This includes a tiered cover 12 with an outer storage pocket 26. The flexible tiers or straps of the cover 12 can be made of fabric, leather, or any other suitable material. The cover 12 may have one tier as shown in FIG. 5, or several tiers, as illustrated by FIG. 6. A bottom strap 25 supports the pouch 11 in the cover 12. The bottom strap 25 is contiguous with a flexible attached carry strap 20. One or more outer storage pockets 26 can be sewn or otherwise secured to one or more tier(s), and optionally the bottom of the outer storage pocket 26 can be secured to the bottom strap 25 of the cover. Magnetic fastener portions 13 on opposite exterior ends of the pouch 11 attach to corresponding magnetic fastener portions 14 on opposite sides inside the attached carry strap 20. The pouch 11 has a zipper 15 with a zipper pull 16. The cover 12 shown in FIG. 5 need not have an outer pocket. In its simplest form without tiers, the cover 12 can be used as a reinforced strap to replace the detachable carry strap 21 shown in FIG. 2.

The multi-tiered cover 12 of FIG. 6 also has a bottom strap 25 for supporting a pouch 11. Magnetic snap fastener portions 13 on opposite exterior ends of the pouch 11 attach to corresponding magnetic snap fastener portions 14 on the inside of opposite sides of an attached carrying strap 20. The broken lines indicate a short (e.g., a handle) or long (shoulder) strap. The inner pouch 11 in this figure has a "side" zipper closure 15 which extends around a substantial portion of the periphery of the top face of the pouch. This zipper closure is conveniently opened by the user using a zipper pull 16 because the top face of the pouch 11 extends slightly above the top tier on the cover. The pouch can thus be opened while the tiered handbag is being worn.

In this unique handbag, the pouch material preferably shows between the tiers of the cover 12. The tiers may be beaded, fringed, or vibrantly colored to contrast with the color theme of the pouch 11. The tiered cover 12 can be lined with fabric that is sewn on or otherwise attached to the top tier for added color and texture. A lining can be secured to the attached carry strap 20 below the magnetic fastener portions 14, or an opening can be provided in the lining so that the corresponding magnetic portions 13 on the pouch 11 can be connected, thereby securing the pouch 11 to the cover 12.

There may be one or more tiers in the multi-tiered cover. Preferably, the pouch is substantially free-standing, and the cover comprises one or two carry straps, one or two bottom straps, each attached to and contiguous with a carry strap, and at least one tier which is perpendicular to and intersects a carry strap. These straps make up the cover. The bottom straps and the tiers support the pouch in the cover.

In a preferred embodiment, the cover comprises: a generally vertical bottom strap supporting the pouch at the bottom; top and bottom tiers extending horizontally around and supporting the pouch; a carry strap attached to and contiguous with the bottom strap; and magnetic snap fastener portions on opposite sides of the inside of the carry strap. The top and bottom tiers are perpendicular to and attached to the carry strap, and the pouch fits snugly into the cover. There may be additional tiers between and parallel to the top and bottom tiers.

In another variation, a tiered handbag or shoulder bag according to the present invention has two carry straps which are connected at the bottom to form a sling. The pouch sits on the bottom portion of the sling, so that it is supported by these vertical straps. One or more horizontal tier(s) intersect the two carry straps at right angles (to the two carry straps). The horizontal tier(s) support the front and back of the pouch. The magnetic fastener portions are at opposite ends of a horizontal tier. The magnetic fasteners may be on the opposite ends of the outside of the pouch and/or they may be on the front and back faces of the pouch.

Figure 7:
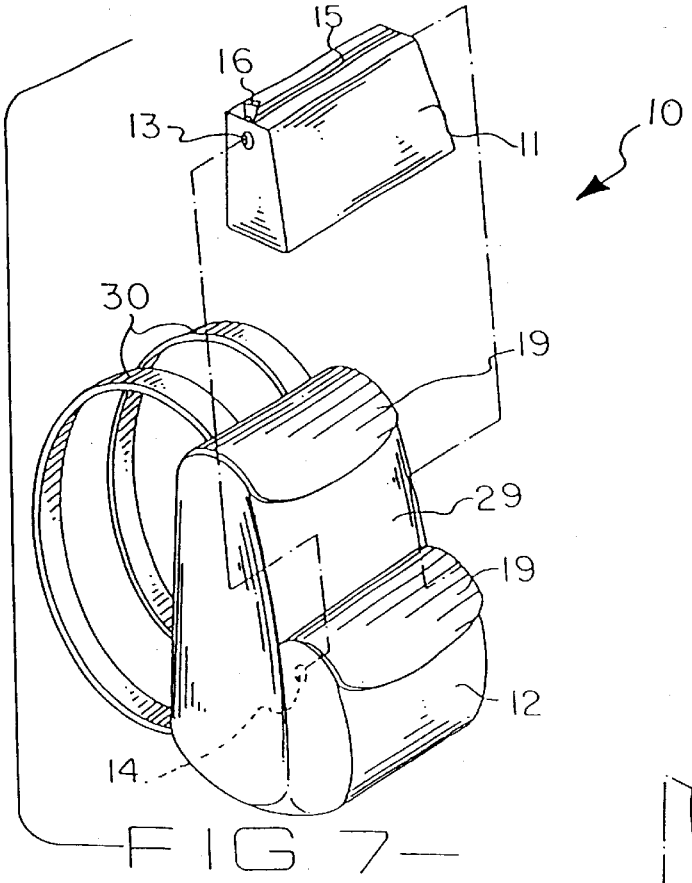
FIG. 7 shows a perspective view of a knapsack with a cover and an inner pouch according to the present invention.

Referring to FIG. 7, a three dimensional, trapezoidal-shaped pouch 11 with a zipper closure 15 and zipper pull 16 on top can be inserted into a cover 12 which is part of a knapsack (also called a backpack) carry bag 10. The backpack carry bag has two straps 30 in back for carrying it. In the embodiment shown, there is a main backpack compartment 29 in back for books or other items, and a smaller compartment in front that the pouch fits into snugly. , The cover compartment for the pouch in FIG. 7 is covered by an exterior flap 19. Conventional knapsack outer closures can be used. The pouch 11 has magnetic fastener portions 13 at each end which are removably secured to corresponding magnetic fastener portions 14 inside the front cover compartment. There may be other types of pockets or compartments inside the knapsack. This embodiment is convenient for students who do not wish to carry a separate purse or pack, but do not wish to carry their books everywhere. Users could carry books and other items to school in the knapsack. They could then leave their knapsacks in their class or locker, for example, and remove the pouch to carry certain smaller items such as money, cosmetics, sunglasses, and/or keys to lunch or break. On their return, they could slip the pouch back inside the cover compartment in the knapsack. Unlike carrying a purse inside a commonly available knapsack, with the present invention the user need not rummage around inside the knapsack because the pouch will always be fixed in the same place. Also, if the knapsack of the present invention is upset, the pouch 11 is unlikely to be dislodged.

Figure 8:
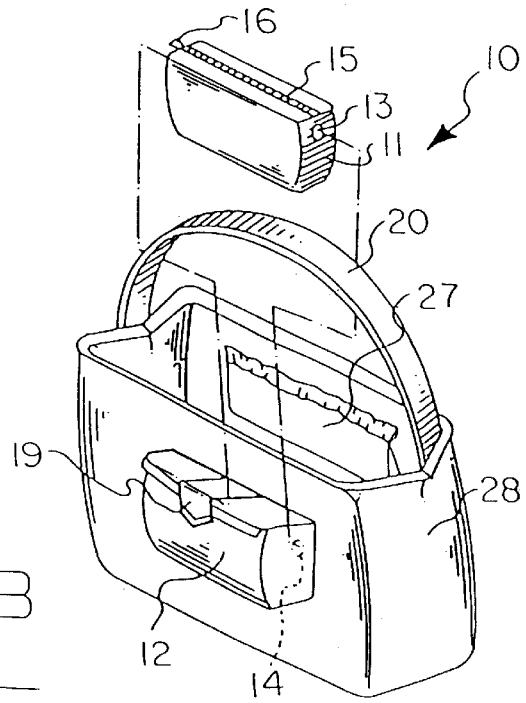
FIG. 8 shows a perspective view of a diaper bag with an inner pouch and a cover according to the present invention.

The last figure, FIG. 8, shows a diaper carry bag 10 with an inner pouch 11 and a cover 12. The pouch 11 has a zipper closure 15 with a zipper pull 16. Again, the ends of the pouch 11 hold corresponding magnetic fastener portions 13 which snap into magnetic fastener portions 14 inside the cover 12 when the pouch 11 is inserted into a cover compartment on the front of a main diaper bag compartment 28. An exterior flap 19 closes the cover compartment over the pouch. The cover compartment is advantageous in that it keeps the pouch separate from the baby items, and in a designated place. The baby items are not contaminated by the personal items in the pouch, and vice versa. It is not necessary to include an exterior flap 19 because the pouch 11 has its own zipper closure 15. The magnetic fastener portions could alternatively be placed in a cover compartment within the diaper bag, similar to the cover compartment in the briefcase in FIG. 3. Inner pockets 27 are preferably provided in the diaper bag cover, and may be included in various other embodiments herein. An attached carrying strap 20 is provided for carrying the diaper bag. In use, the pouch 11 can, for example, be extracted in order to drop off the baby with the rest of the diaper bag at a baby-sitter's house, or to run to the store without having to take the entire contents of the diaper bag.

Figure 7A:
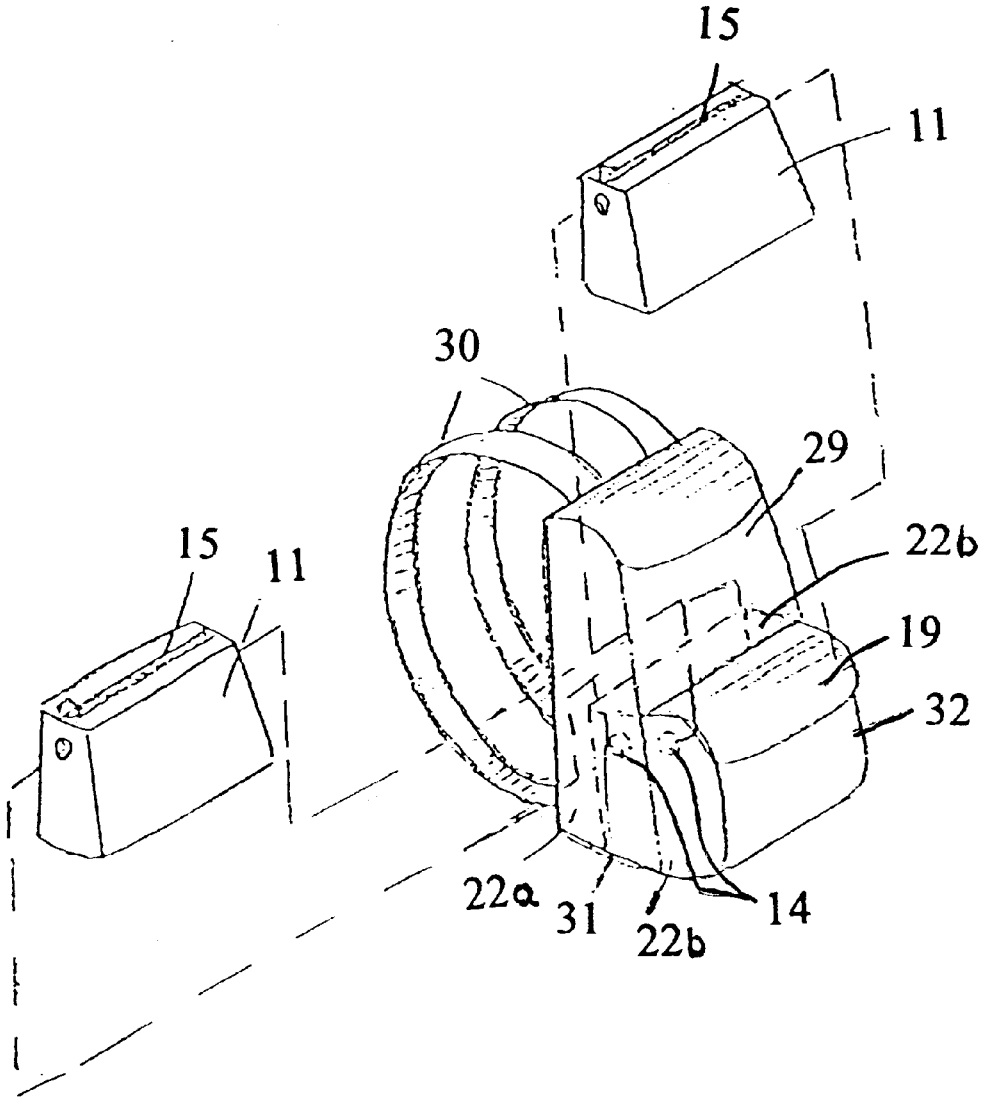
FIG. 7*a* shows a perspective view of a knapsack carry bag according to the present invention, showing two pouch compartments.

A cry bag may comprise two pouches. In that case, both pouches could fit into interior cover compartments, or one pouch could fit into an interior cover compartment, and one could be inserted into a cover compartment on the front of the carry bag. In FIG. 7*a*; one carry bag bas two pouches 11 insertable into an interior pouch compartment 22*b* having an interior partition 31, and a second exterior pouch compartment in an exterior pocket 32.

In FIG. 7*a*, one Carry bag has two pouches 11 insertable into an interior pouch compartment 22*b* having an interior partition 31, and a second, exterior pouch compartment in an exterior pocket 32.

Traditional buttons and buttonholes are not employed in the present invention to hold the inner pouch in the cover. The magnetic fasteners of the present invention are advantageous in that they enable the user to remove the pouch very easily and quickly from one cover and quickly and easily reinsert it in another cover.

Furthermore, the present invention preferably:

does not comprise an inner pouch or bag with extending strips which project into pockets in the cover;

does not include eyelets and studs for holding the inner pouch in the cover;

does not include a spring latch;

is not an outer decorative fabric cover which the user selects and attaches to a handbag frame;

does not require flap means associated with an underlying, removable cover to hold the ends of the flaps in order to secure the inner pouch; and does not include a separable decorative cover which is a one-piece, thin, flexible sheet shaped to cover panels of a bag body in a releasable manner.

The inner pouch of the present invention preferably:

is not a rigid inner shell member attachable to interchangeable covers;

is not envelope-shaped, and does not include frame elements or a snap closure, or flexible tape fastener elements;

is not made of a material that is substantially elastic;

is not pulled in and out of the cover by means of finger loops; and does not require attachment to a frame and function as a purse lining.

is not open-mouthed. This is advantageous because, assuming the user has substantially closed the pouch closure, the contents of the pouch will not spill out during transfer between covers or while the pouch is in the cover, regardless of the type of cover.

From the foregoing it can be realized that the described device of the present invention may be easily and conveniently utilized. While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

What is claimed is:

1. A carry bag for storing personal articles, the carry bag comprising:

a. a closable, free-standing pouch comprising a central storage area and two end faces, which are substantial y parallel and opposite to each other;

b. a closure mechanism in the lop face of the pouch;

c. at least two magnetic fastener, each comprised of at least two corresponding portions; at least one of the magnetic fastener portions being secured to the pouch;

d. a detachable, carrying strap having two opposite ends with a corresponding magnetic fastener portion secured to each end of the carrying strap; or a detachable circular strap with a corresponding magnetic fastener portion secured to the circular strap, a bottom section of the circular strap being adapted to support the pouch, and an opposite, top section of the circular strap being adapted for carrying the carry bag over a user's shoulder or hand; and e. a cover comprising an open cover compartment comprising an interior partition dividing the cover compartment into a pouch compartment and another compartment, the pouch compartment comprising two compartment ends, which are opposite and generally parallel to each other, the interior partition comprising one of the pouch compartment ends; and wherein a magnetic fastener portion is secured to a cover compartment end panel; and wherein the carry bag further comprises a storage compartment adjacent to the cover compartment.

2. A carry bag according to claim 1, further comprising: one or two carrying straps attached to the cover and one or more exterior pockets on the cover; wherein the closure mechanism is a zipper closure and the carry bag is a handbag or briefcase.

3. A carry bag according to claim 1, further comprising a second, separate, smaller cover compartment for a second pouch in front of and attached to the carry bag, the cover compartment further comprising a mechanism for opening and closing the cover compartment.

4. A carry bag according to claim 1, further comprising a front panel with an attached, smaller cover compartment for holding the pouch, and at least one interior pocket; and wherein the magnetic fasteners are magnetic snap fasteners, each having a male portion and a corresponding female portion.

5. A carry bag according to claim 1, further comprising an outer storage pocket on one end of the cover, and wherein the cover compartment for the pouch is inside the carry bag cover; and the magnetic fasteners are magnetic snap fasteners, each having a male portion and a corresponding female portion.

6. A kit for building two or more different carry bags for different occasions, the kit comprising a pouch, a detachable carrying strap, and two or more different covers, each cover comprising a cover compartment, the pouch comprising a closure mechanism in a top face of the pouch for opening and closing the pouch; the pouch and cover further comprising at least two magnetic fasteners, each magnetic fastener being comprised of at least two corresponding portions; at least one of the magnetic fastener portions being secured to a face of the pouch, with a corresponding magnetic snap fastener portion being secured to an inside face of the cover; and wherein the carry bag is a handbag, shoulder bag, briefcase, tote bag, diaper bag, evening bag, beach bag, piece of luggage, knapsack, lunch box, camera bag, phone bag, cosmetic bag, or an organizer.

* * * * *